US008814261B2

(12) United States Patent
Chamberlain et al.

(10) Patent No.: US 8,814,261 B2
(45) Date of Patent: Aug. 26, 2014

(54) ADIRONDACK CHAIR WITH DOUBLE FULCRUM

(76) Inventors: Stephen L. Chamberlain, Salt Lake City, UT (US); Amber D. Chamberlain, Salt Lake City, UT (US)

( * ) Notice: Subject to any disclaimer, the term of this patent is extended or adjusted under 35 U.S.C. 154(b) by 510 days.

(21) Appl. No.: 13/082,651

(22) Filed: Apr. 8, 2011

(65) Prior Publication Data

US 2012/0256449 A1 Oct. 11, 2012

(51) Int. Cl.

| | |
|---|---|
| ***A47C 4/04*** | (2006.01) |
| ***A47C 4/00*** | (2006.01) |
| ***A47C 7/50*** | (2006.01) |
| ***A47C 7/54*** | (2006.01) |
| *A47C 4/08* | (2006.01) |

(52) U.S. Cl.

USPC ..... 297/39; 297/35; 297/31; 297/16.1

(58) Field of Classification Search

USPC ..... 297/16.1, 31, 35, 39, 40, 41, 46, 51, 52, 297/59, 60, 447.3, 450.1

See application file for complete search history.

(56) References Cited

U.S. PATENT DOCUMENTS

| | | | | | |
|---|---|---|---|---|---|
| 444,992 | A | * | 1/1891 | Henry | 297/20 |
| 794,777 | A | | 7/1905 | Bunnell | |
| 1,021,360 | A | * | 3/1912 | Edstrom | 297/16.1 |
| 1,716,526 | A | * | 6/1929 | Mason | 297/59 |
| 1,855,130 | A | * | 4/1932 | Appleby | 297/21 |
| 1,916,771 | A | * | 7/1933 | Parks | 297/19 |
| 1,947,410 | A | * | 2/1934 | Emerson | 297/39 |
| 2,195,461 | A | * | 4/1940 | Koenig | 297/31 |
| 2,229,154 | A | * | 1/1941 | Watling | 297/39 |
| 2,468,491 | A | * | 4/1949 | Dorschner | 297/31 |
| 2,490,884 | A | * | 12/1949 | Rau | 297/440.15 |
| 2,547,897 | A | * | 4/1951 | Wozniak | 297/31 |
| 2,600,374 | A | * | 6/1952 | O'Neill | 297/31 |
| 2,650,652 | A | * | 9/1953 | Watson | 297/31 |
| 2,765,525 | A | * | 10/1956 | O'Neill | 228/170 |
| 2,948,332 | A | * | 8/1960 | Hamilton | 297/59 |
| 3,186,757 | A | * | 6/1965 | Hopkins | 297/28 |
| 4,072,341 | A | * | 2/1978 | Kurz | 297/27 |
| 4,514,009 | A | * | 4/1985 | Vanderminden et al. | 297/27 |
| 4,838,608 | A | * | 6/1989 | Hansen-Smith et al. | 297/27 |
| 5,120,071 | A | * | 6/1992 | Thibault et al. | 280/47.4 |

(Continued)

OTHER PUBLICATIONS

Adirondack Chair; retrieved from http://en.wikipedia.org/wiki/Adirondack_chair on Mar. 9, 2011.

(Continued)

*Primary Examiner* — David R Dunn
*Assistant Examiner* — Tania Abraham
(74) *Attorney, Agent, or Firm* — Workman Nydegger

(57) ABSTRACT

Collapsible chairs and related chair systems. An exemplary chair includes a base member comprising a seat surface configured to support a user sitting thereon, a back supporting member behind the seat surface configured to support a user's back when a user is seated, and parallel first and second side members each including first and second fulcrums. The first fulcrums connect the side members to the base member disposed therebetween. The second fulcrums connect the side members to the back supporting member disposed therebetween. The side members define a frame within which the back supporting member and the base member may be rotated about their respective fulcrums. The fulcrums allow the chair to be collapsed to a more compact configuration (e.g., for storage).

13 Claims, 13 Drawing Sheets

(56) References Cited

U.S. PATENT DOCUMENTS

| | | | | |
|---|---|---|---|---|
| 5,282,664 | A * | 2/1994 | Tseng | 297/31 |
| 5,681,078 | A * | 10/1997 | Chen | 297/58 |
| 5,911,469 | A * | 6/1999 | Young | 297/31 |
| 6,113,181 | A * | 9/2000 | Tang | 297/27 |
| 7,195,310 | B2 * | 3/2007 | Reese | 297/19 |
| 7,401,854 | B2 * | 7/2008 | Adams | 297/239 |
| 2003/0111873 | A1 * | 6/2003 | Tseng | 297/27 |

OTHER PUBLICATIONS

Collapsible chair, approximately 20 of which were distributed to and assembled by participants, based on information and belief, at least as early as Jul. 2009, at Quickwater Ranch, a summer girls camp and family camp in Idaho, United States of America, 11 photographs of chair.

* cited by examiner

ADIRONDACK CHAIR WITH DOUBLE FULCRUM

BACKGROUND

1. The Field of the Invention

The present invention relates to chairs and related seating systems.

2. Background and Relevant Art

Chairs have provided people with a support for sitting for centuries. Such chairs are available in a myriad of styles, designs, and with various features. One chair that is often used outdoors is the so-called Adirondack chair, which was developed by Thomas Lee and Harry Bunnell in the Adirondack Mountains area of New York around the turn of the $19^{th}$ to the $20^{th}$ century. Adirondack chairs are often made of wood, having something of a "rustic" appearance, and may include a high back and/or wide armrests.

SUMMARY

The invention generally relates to collapsible chairs and related systems including at least one chair. Terms such as front, back, top, bottom, forward, behind, above, and below as used herein when referring to components of the chair or related chair systems generally refer to the relative location when the chair is in an opened, uncollapsed configuration unless otherwise stated. According to one embodiment, the chair includes a base member comprising a seat surface configured to support a user sitting thereon, and a back supporting member behind the seat surface, the back supporting member being configured to support a user's back when a user is seated on the seat surface. The chair further includes first and second side members each including spaced apart first and second fulcrums, the first side member being connected to a first side of the base member through the first fulcrum and the first side member being connected to the same first side of the back supporting member through the second fulcrum. The second side member is similarly connected on the opposite side of the chair, so that the second side member is connected to a second opposite side of the base member through the first fulcrum of the second side member and the second side member is also connected to the same second side of the back supporting member through the second fulcrum of the second side member.

The base member and back supporting member are not directly connected to one another, and the first fulcrums of the side members are aligned with one another, such that the base member is pivotable about the first fulcrums. Similarly, the second fulcrums of the side members are aligned with one another such that the back supporting member is also pivotable about the second fulcrums. The side members are parallel to one another, and define a frame within which the base member and the back supporting member can be pivoted relative to the frame provided by the parallel side members.

Because the base member and back supporting member are pivotable within the frame provided by the side members, the chair is collapsible. For example, beginning from the opened uncollapsed chair configuration, the back supporting member may be pivoted about the second fulcrum between the side members in a direction so that the top of the back supporting member pivots towards the base member. The back supporting member continues to be pivoted until it becomes substantially aligned with the longitudinal plane of the frame defined by the two side members. Similarly, the base member is simultaneously allowed to drop towards the floor as the base member and side members pivot about the first fulcrum until the base member is also collapsed so as to be substantially aligned with the longitudinal plane of the frame defined by the side members. Once both the back supporting member and base member have been fully rotated to be substantially aligned with the longitudinal plane of the frame, the chair is in a collapsed condition. Of course, because the chair includes two fulcrums, different collapsed configurations are possible depending on the direction of rotation about each fulcrum (i.e., rotation of the back supporting member or base member may be in an opposite direction). In any case, when collapsed, the base member, the back supporting member, and the frame of the side members are substantially aligned in similar longitudinal planes so as to be significantly more compact than when the chair assumes a configuration for use.

The first fulcrums may be disposed within a central portion (e.g., at about the center) of each side member. The second fulcrums may be disposed near a top end of each side member, and oppositely disposed bottom ends of each side member serve as front legs of the chair. In one embodiment, both the first and second fulcrums may be disposed at a location about ⅓ the length from the leading edge of the seat member of the base member and about ⅓ the length from the top of the back supporting member.

The base member may be substantially straight, and include a front end, a central portion, and a back end. The seat surface may be disposed at the front end of the base member. The first and second side members (which may also be straight) may be connected to the central portion of the base member through the first fulcrums, and the back end of the base member may serve as back legs of the chair.

Another embodiment of the chair comprises a lounge chair including the base member, back supporting member, and side members as described above, and that further includes a leg rest assembly hingedly connected to the base member so that the leg rest member is disposed in front of the seat surface of the base member when in the opened, uncollapsed configuration. The lounge chair may also include opposing arm rest assemblies connected to and extending outwardly from the side members. Each arm rest assembly may include a substantially horizontal arm rest member extending between a free first end and an opposite second end that is connected to a respective side member at the second fulcrum. Each arm rest assembly may further include a selectively positionable support member having a free first end that is positionable within a slot near the free first end of the corresponding arm rest member to support the arm rest member in the substantially horizontal position. An oppositely disposed second end of the support member may be connected to a respective side member at the first fulcrum.

Another embodiment of a related system includes both a chair and a lounge chair as described above, and wherein the collapsible chair and collapsible lounge chair become nested together when collapsed. For example, the collapsed chair and lounge chair may be oriented head-to-foot relative to one another, with the front legs of the chair defining an inside width into which a bottom of the back supporting member of the lounge chair nests. The front legs of the lounge chair define an inside width into which a bottom of the back supporting member of the chair nests, interlocking the chair and the lounge chair together in a compact, collapsed configuration.

One embodiment of the system further includes a collapsible table that when collapsed, fits within the inside width between the back legs of the chair so that the chair can be trapped or nested between the chair and the lounge chair. The entire system may be stored within a portable bag.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

I. Introduction

Embodiments of the invention relate to collapsible chairs and related chair systems. An exemplary chair includes a base member comprising a seat surface configured to support a user sitting thereon, a back supporting member behind the seat surface configured to support a user's back when a user is seated, and parallel first and second side members each including first and second fulcrums. The first fulcrums connect the side members to the base member disposed therebetween. The second fulcrums connect the side members to the back supporting member disposed therebetween. The side members define a frame within which the back supporting member and the base member may be rotated about their respective fulcrums. The fulcrums allow the chair to be collapsed to a more compact configuration (e.g., for storage).

In another embodiment of a related system, a lounge chair similar to the chair as described above and also including a leg rest assembly hingedly attached to the base member and optional arm rest assemblies connected to the side members is also provided. The chair and lounge chair are configured so that when both are collapsed and oriented head-to-foot relative to one another, the front legs of the chair define an inside width into which a bottom of the back supporting member of the lounge chair nests, while the front legs of the lounge chair similarly define an inside width into which a bottom of the back supporting member of the chair nests. Thus, a system including both the chair, a lounge chair, and an optional table (which may be nested in between the chair and lounge chair) can all be collapsed to a compact configuration, and may be further stored within a portable bag.

II. Exemplary Chairs with Dual Fulcrums

Figure 1A:
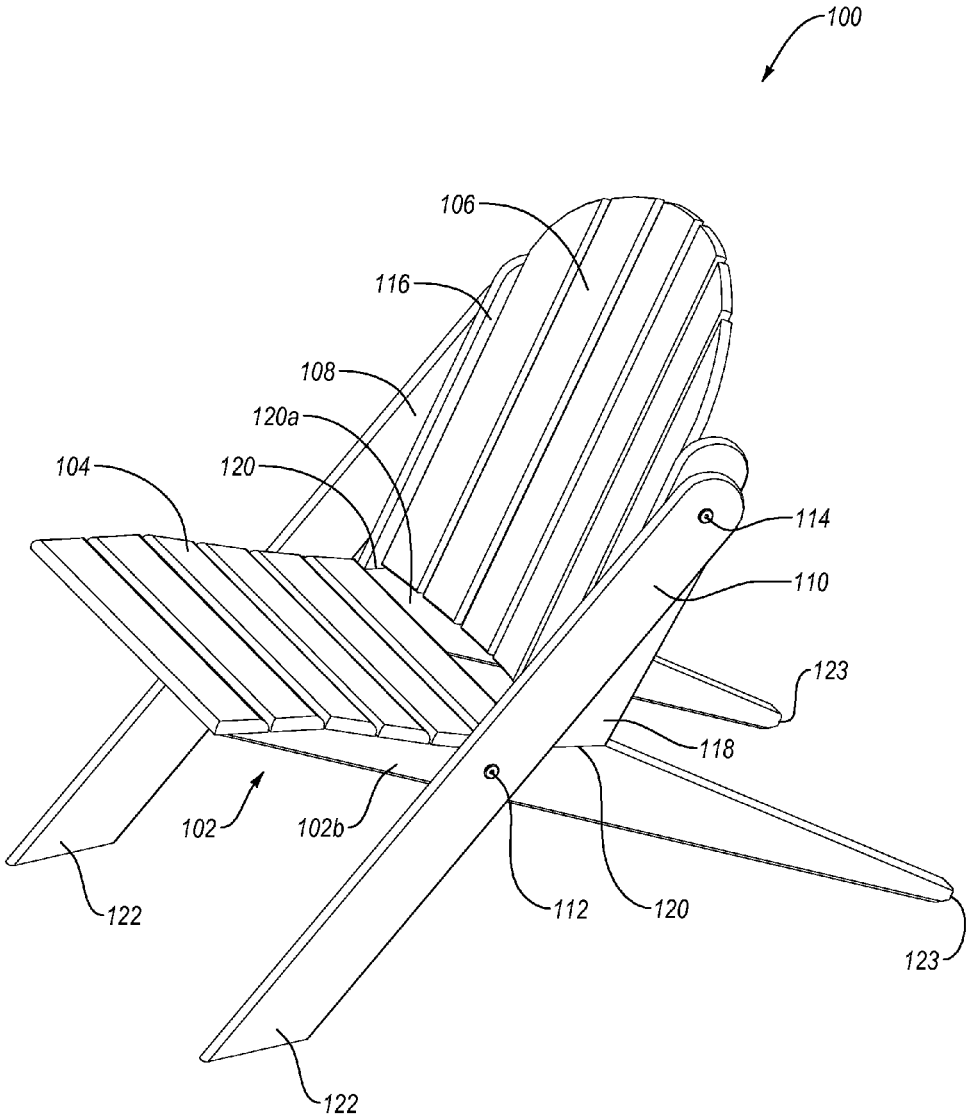
FIG. 1A is a perspective view of an exemplary chair.
Figure 1B:
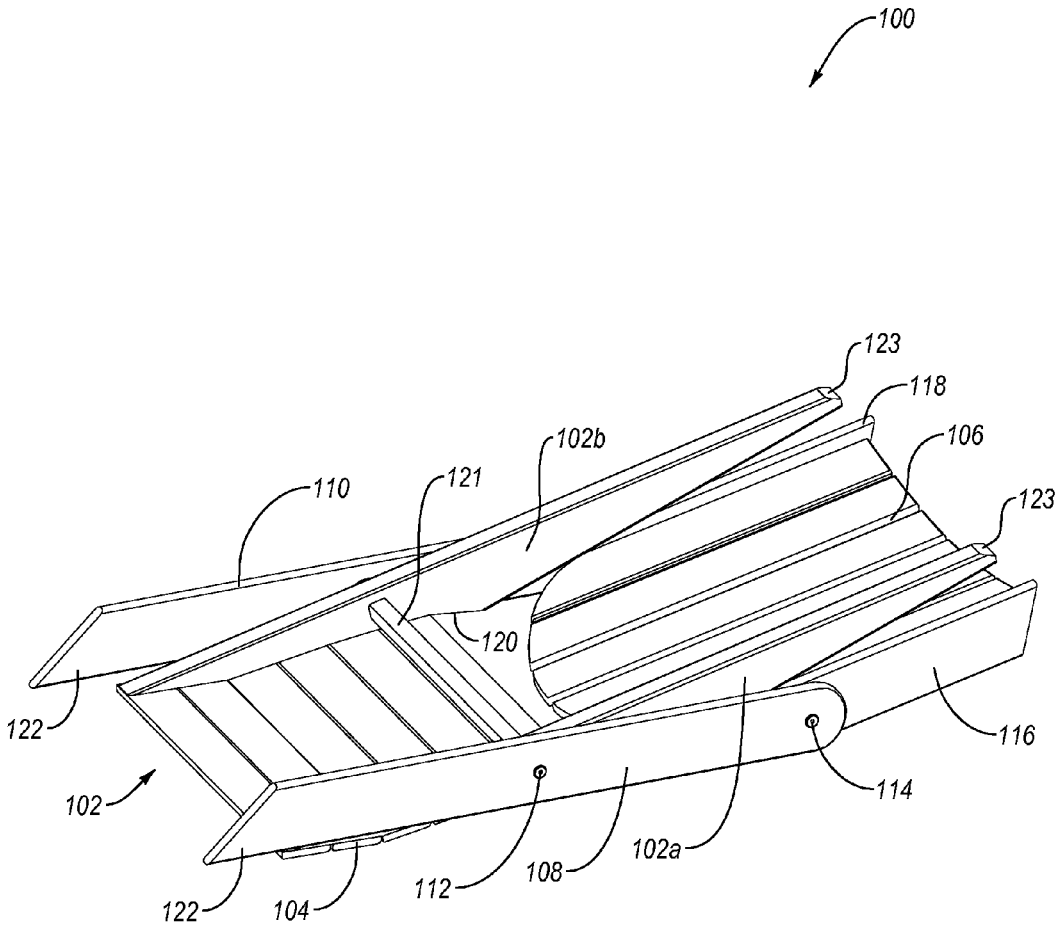
FIG. 1B is a perspective view of the chair of FIG. 1A in a collapsed configuration.
Figure 1C:
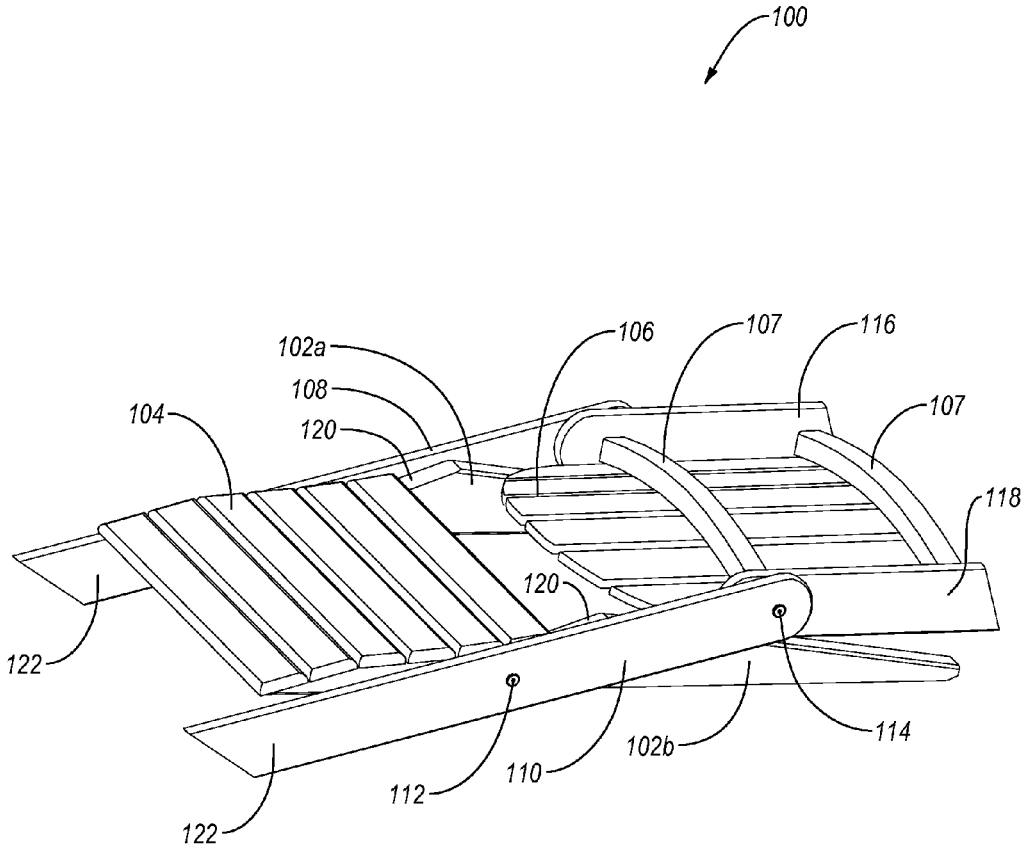
FIG. 1C is another perspective view of the chair of FIG. 1A in a collapsed configuration.

FIGS. 1A-1C show an exemplary collapsible chair 100 including dual fulcrums. Chair 100 includes a base member 102 including a seat surface 104 configured to support a user sitting thereon. Chair 100 also includes a back supporting member 106 disposed behind seat surface 104. Back supporting member 106 is configured to support a user's back when a user is seated on seat surface 104. First and second parallel side members 108 and 110, respectively are also provided. Side members 108 and 110 provide a frame for hinged attachment of base member 102 and back supporting member 106, and may be substantially straight and parallel to one another. Each side member 108, 110 includes a first fulcrum 112 near a center of the side member by which the respective side member is pivotally connected to the base member 102. Similarly, a spaced apart second fulcrum 114, disposed near a top end of each side member 108, 110 connects the side members to back supporting member 106.

In one embodiment, the first fulcrum 112 is disposed within about 25% of the center of each side member, more preferably within about 10% of the center of each side member, and most preferably within about 5% of the center of each side member.

First fulcrums 112 are aligned with one another so that base member 102 is able to pivot about fulcrums 112, within the frame provided by side members 108 and 110 disposed on either side of base member 102. Similarly, second fulcrums 114 are aligned with one another so that back supporting member 106 is able to pivot about fulcrums 114 within the frame provided by side members 108 and 110 disposed on either side of back supporting member 106.

FIG. 1A shows chair 100 in an opened, uncollapsed configuration ready for use. Back supporting member 106 includes a pair of opposed edge members 116 and 118 disposed at the side edges or ends of back supporting member 106, oriented towards side members 108 and 110, respectively. Side members 108 and 110 may be connected to back supporting member 106 through edge members 116 and 118, respectively, as shown. Members 116 and 118 extend generally upwardly in a direction similar to that of the remainder of back supporting member 106. Members 116 and 118 may be oriented to have a width greater than the remainder of back supporting member 106, as shown, so as to provide an engaging surface at the bottom of each member 116 and 118 for resting on supporting surfaces 120 of base member 102.

Seat member 104 may be supported by a pair of base members 102*a* and 102*b* disposed below seat member 104. In such an embodiment, base member 102 includes opposing base members 102*a* and 102*b*. Seat member 104 may act as a stop against which edge members 116 and 118 of back supporting member 106 may abut when pivoted to the open, uncollapsed configuration shown in FIG. 1A. Furthermore, each base member 102*a* and 102*b* may comprise a flat, horizontal support surface 120 against which the bottom of edge members 116, 118 are supported when chair 100 is opened. In other words, back supporting member 106 is rotated so that edge members 116 and 118 abut against the back of seat member 104, while simultaneously resting on support surfaces 120 of base members 102*a*, 102*b* on either side of the chair 100.

As seen in FIG. 1C, back supporting member 106 may further include lateral braces 107 extending between opposing edge members 116 and 118, to which the individual slat members of back supporting member 106 may also be connected. One lateral brace 107 may be substantially aligned with second fulcrum 114, while the other lateral brace 107 is disposed near the bottom of back supporting member 106. The slats of back supporting member 106 may extend upwards beyond the upper lateral brace 107. As shown, lateral braces 107 may be curved, resulting in the slats of back supporting member 106 also providing a curved configuration, which better corresponds to a user's back. Such a configuration may also provide a space between the bottom of the curved central portion of back supporting member 106 and a substantially straight seat surface 104, as shown in FIG. 1A.

In the illustrated configuration the bottom ends 122 of each of side members 108 and 110 serve as front legs of the chair to support the chair on a surface (e.g., the ground). As shown, the back end of each of base members 102*a* and 102*b* serve as back legs 123 to also support the chair on a surface.

In one embodiment, the base member may be substantially straight, as shown in FIG. 1A. In another embodiment, the base member may be curved, for example, curving approximately 90° between a substantially vertical back end (e.g., back legs 123) and a substantially horizontal front end (e.g., seat member 104). In such an embodiment the seat member may be generally horizontal, rather than angled downward towards back supporting member 106, as is shown in FIG. 1A. Other embodiments including a curved base member are also possible, for example, the angle of the curved portion may be greater than 90° (e.g., greater than 90° and less than about) 135°, so that the back end (e.g., less 123) contact the ground at an angle less than vertical. Various other configurations will be apparent to one of skill in the art in light of the present disclosure.

Because of dual fulcrums 112 and 114, the chair 100 is collapsible by disengaging the locking mechanism described above by which edge members 116 and 118 abut seat member 104 and rest on support surfaces 120. This may be accomplished by slightly lifting back supporting member 106, which causes or allows rotation of base member 102 about fulcrum 112. This action disengages edge member 116 and 118 from resting on support surface 120, allowing back support member 106 to be rotated in either direction about fulcrum 114. If rotation is in a direction so that the top of back support member 106 is rotated forward, towards seat member 104 while fulcrum 112 is simultaneously allowed to collapse the angle between the side members 108, 110, and base member 102, the chair assumes a collapsed configuration as shown in FIG. 1C. If the collapsed chair is turned over, the configuration is as shown in FIG. 1B. As seen chair 100 may include another lateral brace 121 extending between central portions of side members 108 and 110, the brace 121 being substantially aligned with first fulcrums 112.

As will be readily apparent, the back supporting member 106 and base member 102 are not directly connected to one another, but are each independently rotatable about their respective fulcrums 114 and 112, respectively, within the frame defined by side members 108 and 110. Because members 102 and 106 are not directly connected to one another, they are able to pivot independently, and the chair is able to be collapsed.

The first fulcrums may be disposed within a central portion (e.g., at about the center) of each side member 108 or 110. The second fulcrums may be disposed near a top end of each side member 108 or 110, and oppositely disposed bottom ends of each side member 108 and 110 serve as front legs of the chair. In one embodiment, both the first and second fulcrums 112 and 114, respectively, may be disposed at a location about ⅓ the length from the leading edge of seat member 104 of base member 102 and about ⅓ the length from the top of the back supporting member 106. In one embodiment, the respective fulcrum is within about 25% of the described location, about 10% of the described location, or about 5% of the described location.

Figure 1D:
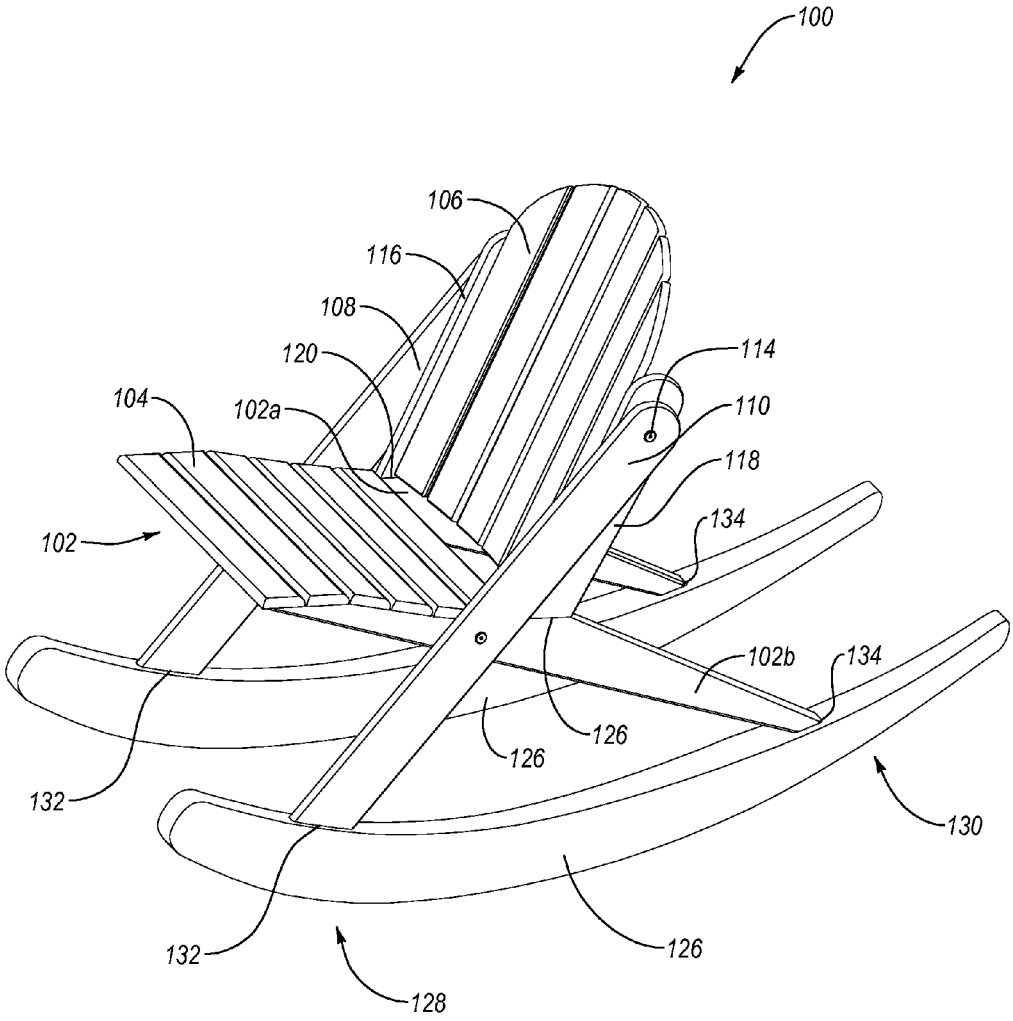
FIG. 1D is a perspective view of the chair of FIG. 1A including a pair of opposed rocking members including slots for receiving the front and back legs of the chair so that the chair is a rocker.

FIG. 1D illustrates a modification to chair 100, in which the chair comprises a rocker. Rocking chair 100 further comprises opposed curved rocking members 126 extending between first end 128 and second end 130. Slot 132 is formed in each rocking member 126 near first end 128 and is configured to receive front legs 122 of chair 100. A slot 134 is formed in each curved rocking member 126 near second end 130 and is configured to receive back legs 123 so that chair 100 is rockingly supported on opposed curved rocking members 126. Slots 132 and 134 may be formed into the top surfaces of each rocking member 126, or alternatively may be formed into either side of the rocking members 126. In order to maintain the collapsibility of the chair 100, it may be possible to insert and subsequently remove the legs from the slots, so as to disengage the legs from rocking members 126. Where slots 132 and 134 are formed into a side of rocking members 126, attachment may be by bolts or other suitable fasteners. Various connection mechanisms will be apparent to one of skill in the art in light of the present disclosure.

Figure 2A:
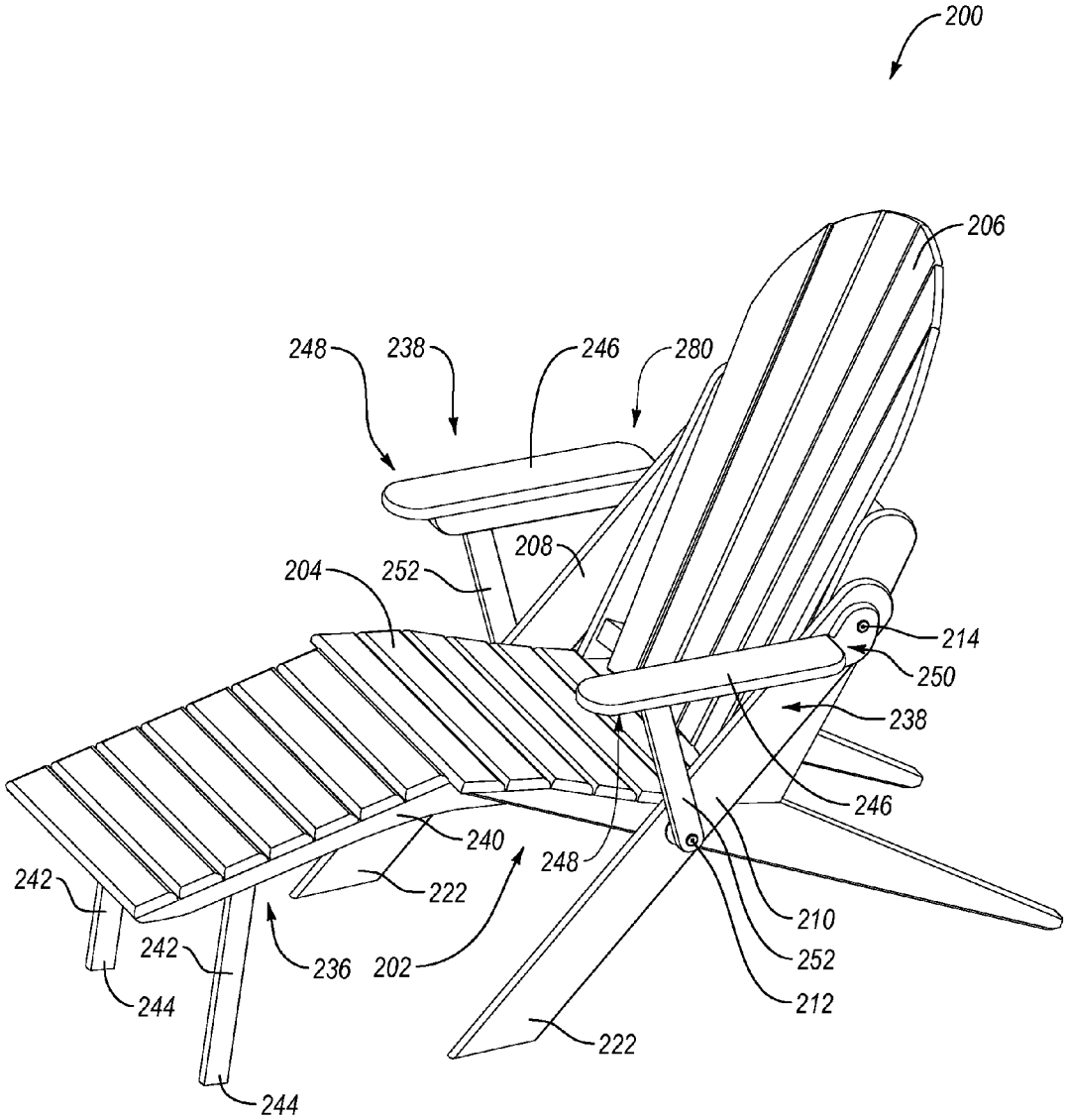
FIG. 2A is a perspective view of an exemplary lounge chair.
Figure 2B:
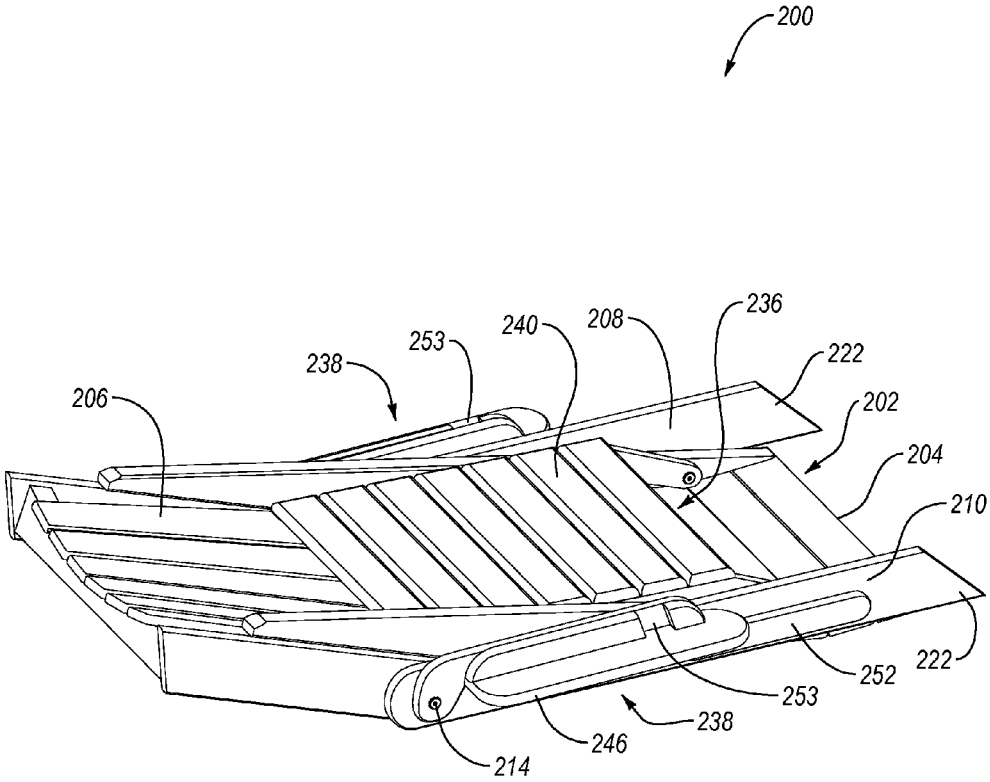
FIG. 2B is a perspective view of the lounge chair of FIG. 2A in a collapsed configuration.
Figure 2C:
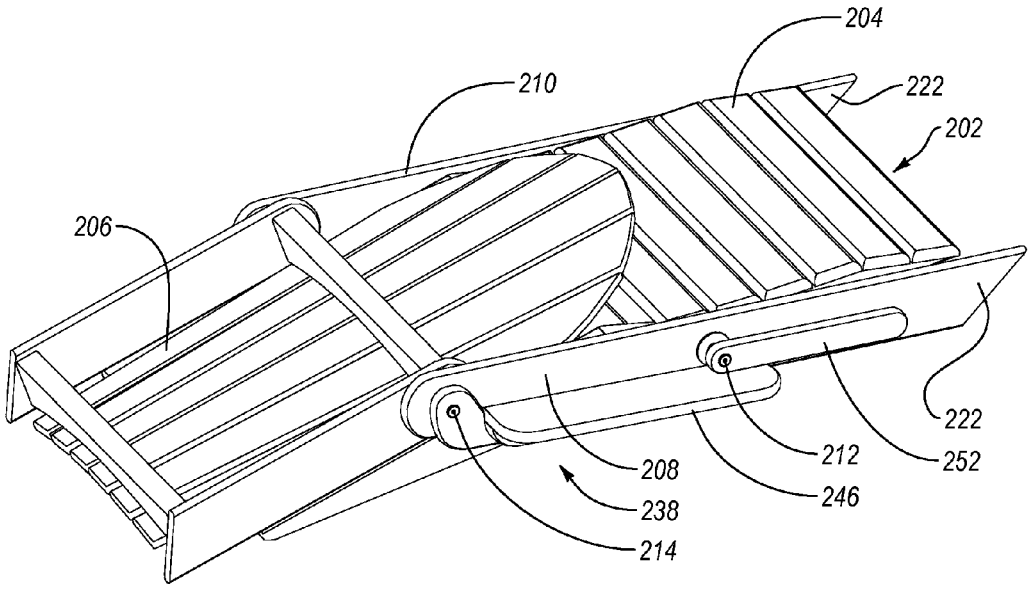
FIG. 2C is another perspective view of the lounge chair of FIG. 2A in a collapsed configuration.

FIGS. 2A-2C illustrate a lounge chair 200 that is similar to chair 100, but which is configured as a lounge chair. Lounge chair 200 similarly includes a base member 202, a back supporting member 206, and first and second side members 208 and 210, respectively. Back supporting member 206 may be similar to back supporting member 106 of chair 100, although the length of the slats defining the back supporting member 206 are shown as being substantially longer than those of chair 100. Lounge chair 200 further includes a leg rest assembly 236 and a pair of opposing arm rest assemblies 238. Leg rest assembly 236 includes a leg rest member 240 hingedly connected to base member 202 so that leg rest member 240 may be folded rearwardly, under seat member 204. Leg rest assembly 236 further includes opposing support legs 242. Each support leg 242 includes a free end 244 and an opposite second end that is hingedly connected to the leg rest member 240 so that when the free ends 244 are pivoted downward as shown in FIG. 2A they serve as legs of assembly 236 to support the free end of the leg rest member 240.

As shown, the leg rest member 240 may be of a width that is less than seat member 204, so as to allow it to be folded up under seat member 204, between the individual base members of base member 202. For example, leg rest member 240 may have a width approximately equal to the width defined between the individual base members of base member 202.

Each arm rest assembly 238 is connected to the corresponding side member 208 or 210 at two points (e.g., at fulcrums 212 and 214). Each assembly 238 includes a substantially horizontal arm rest member 246 extending between a first free end 248 and an opposite second end 250 connected to the respective side member 208 or 210 (e.g., at second fulcrum 214). Each assembly 238 further includes a selectively positionable support member 252 having a free first end that is positionable within a slot 253 (see FIG. 2B) formed into a bottom surface, near the first free end 248 of each arm rest member 246. An oppositely disposed second end of support member 252 is connected to a respective one of corresponding side members 208 or 210 at first fulcrum 212.

The arm rest assemblies 238 are also configured to be collapsible. For example, as the support member 252 is pulled out of slot 253, arm rest member 246 is able to rotate about fulcrum 214 so as to collapse to be substantially in-line and longitudinally aligned with its respective side member 208 or 210. Similarly, support member 252 is able to rotate about fulcrum 212 so as to collapse to be substantially in-line with its respective side member 208 or 210.

Lounge chair 200 is able to be collapsed in a similar manner as described above relative to chair 100, while the leg rest assembly 236 and arm rest assemblies 238 are also able to be collapsed to a more compact configuration as shown in FIGS. 2B and 2C. For example, arm rest assemblies may be collapsed by lifting arm rest member 246 so as to disengage support member 252, and these components may be allowed to pivot so as to be aligned with their respective side member 208 or 210, as described above. For leg rest assembly 236, support legs 242 may be pivoted upward, under leg rest member 240, while leg rest member 240 is pivoted underneath seat member 204 of base member 202. FIG. 2B shows lounge chair 200 in one collapsed configuration, while FIG. 2C shows the opposite side (i.e., flipped over) so as to better illustrate the relationship and orientation between the various components.

Although the arm rest assemblies 238 and leg rest assembly 236 are shown in conjunction with lounge 200, it will be understood that various features may be combined from the various illustrated and described embodiments. For example, an arm rest assembly or leg rest assembly may be provided with chair 100.

Figure 3A:
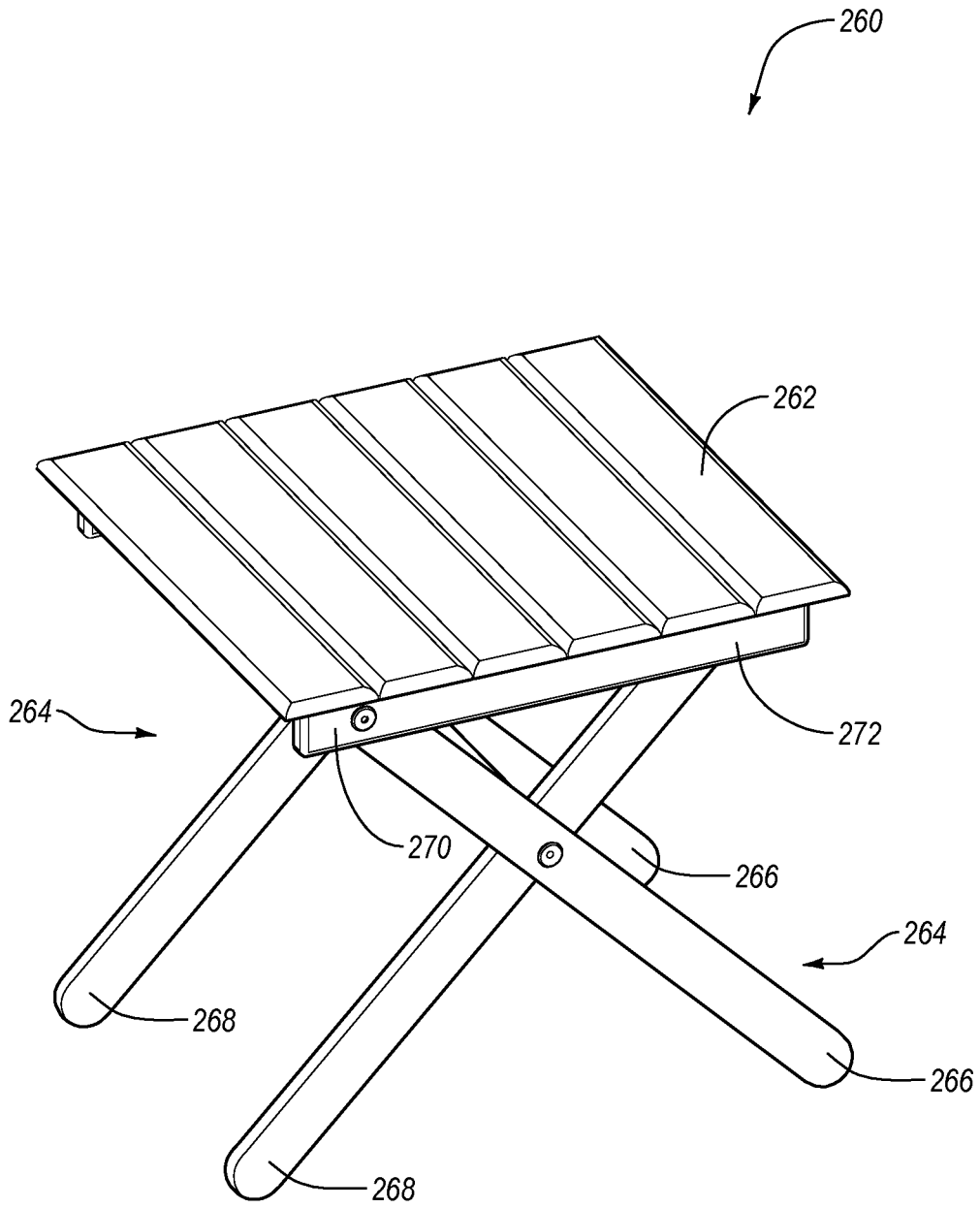
FIG. 3A is a perspective view of an table associated with either or both of the chairs of FIGS. 1A and 2A.
Figure 3B:
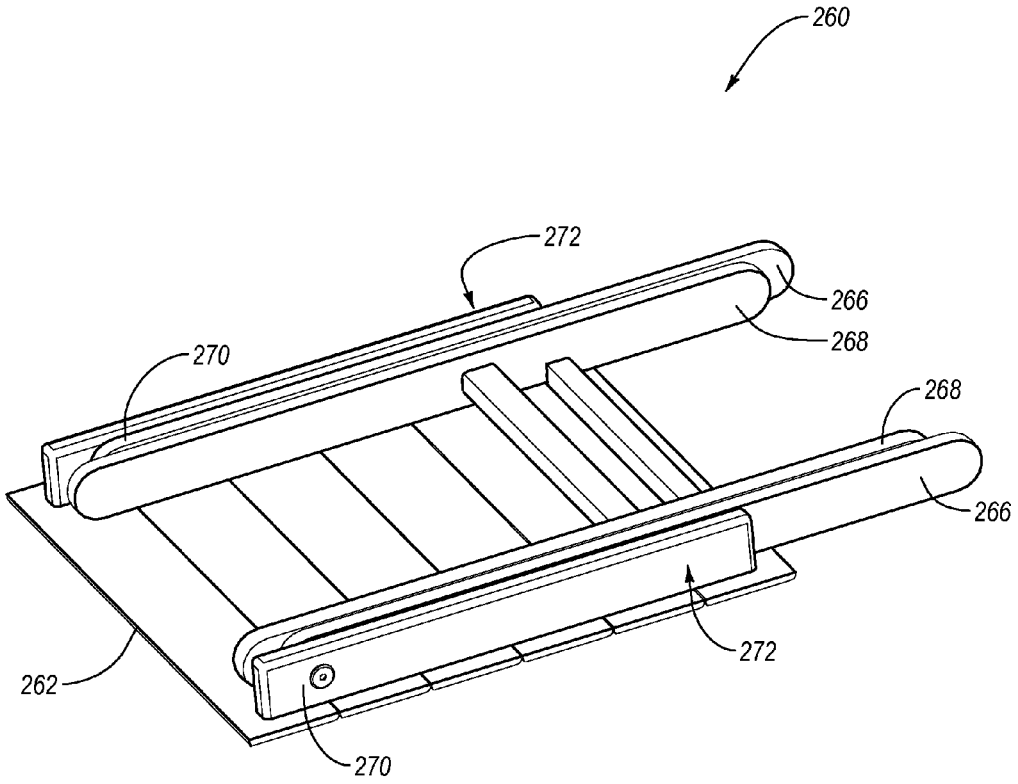
FIG. 3B is a perspective view of the table of FIG. 3A in a collapsed configuration.

FIG. 3A illustrates a small side table that may be associated with any of the collapsible chairs. Table 260 includes a table top member 262 and a pair of opposed scissoring legs 264. Each scissoring leg includes a first leg 266 and a second leg 268 which are pivotally connected to one another at a central portion of each leg 266 and 268. The lower free end of each leg 266 and 268 serves to support the table on a surface (e.g., the ground or floor). The upper end of each leg 266 is hingedly connected to the bottom surface near an end 270 of table top member 262, while the upper end of each leg 268 is also free, and can be abutted against a stop (not shown) disposed on a bottom surface of table top 262 at an end 272 opposite where the ends of legs 266 are hingedly connected at 270. In other words, both ends of legs 268 may be free, while only the bottom end of legs 266 are free. This allows the upper end of legs 268 to be lifted out of abutment with table top 262 at 272, and scissor legs 266 and 268 may then be folded down adjacent to and in line with table top 262, in a configuration as seen in FIG. 3B. As shown in FIG. 3B, in one embodiment both of legs 268 may be on the "inside" while both legs 266 are on the "outside".

Figure 4:
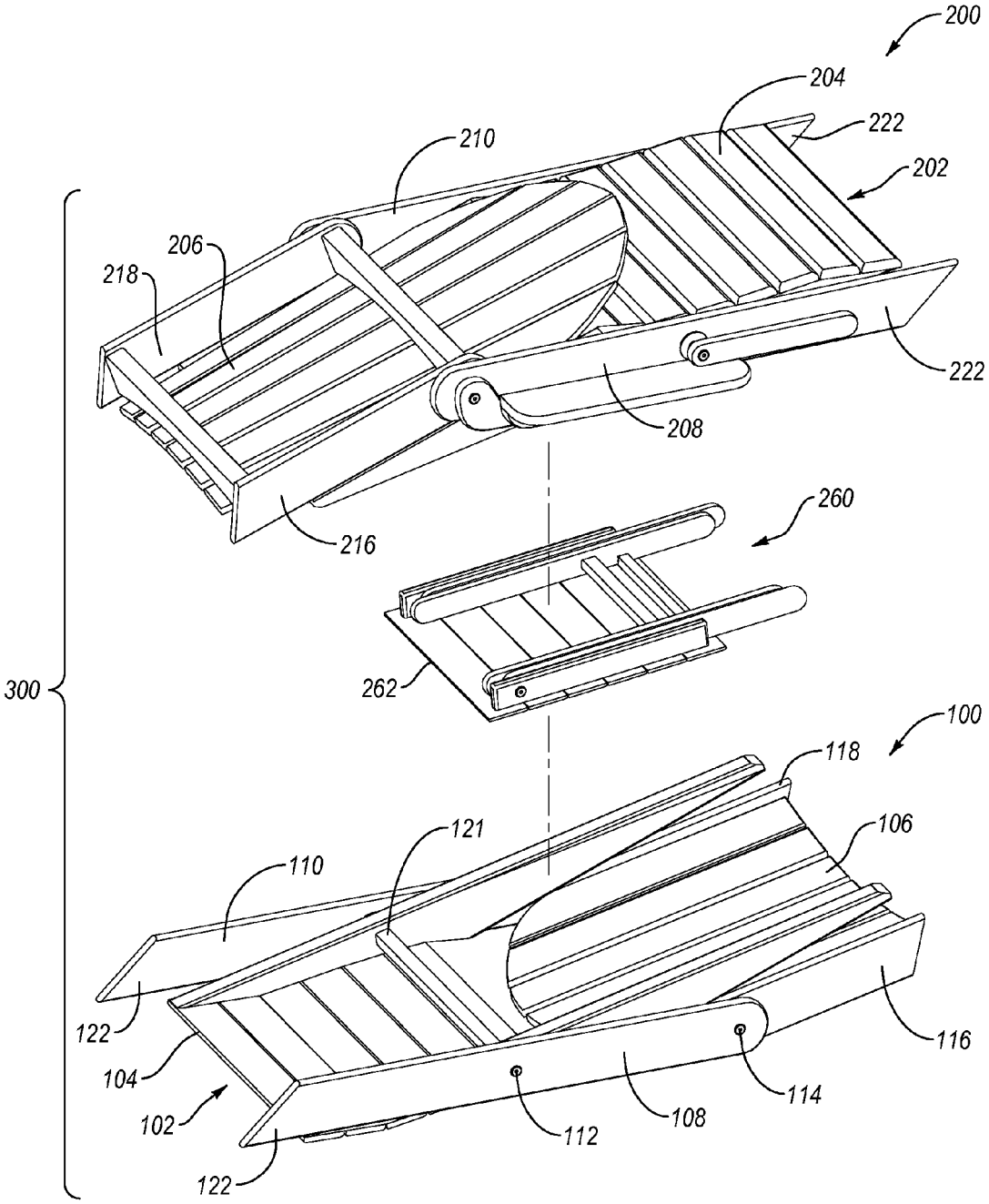
FIG. 4 is an exploded view of the collapsed chair of FIG. 1C, the collapsed table of FIG. 3B, and the collapsed lounge chair of FIG. 2C.
Figure 5:
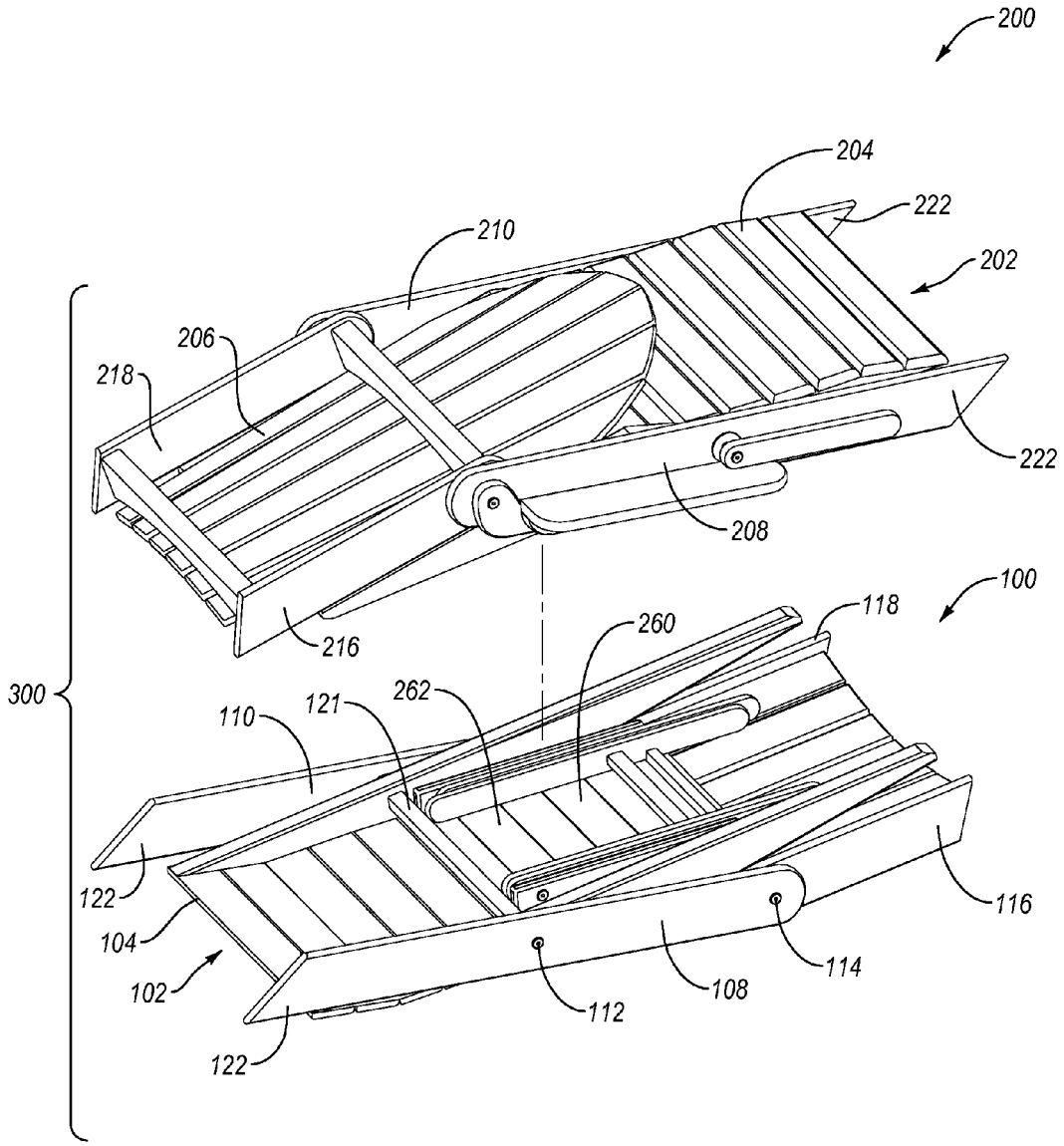
FIG. 5 illustrates the collapsed table of FIG. 4 stacked on the collapsed chair of FIG. 4, with the collapsed lounge shown exploded above.
Figure 6A:
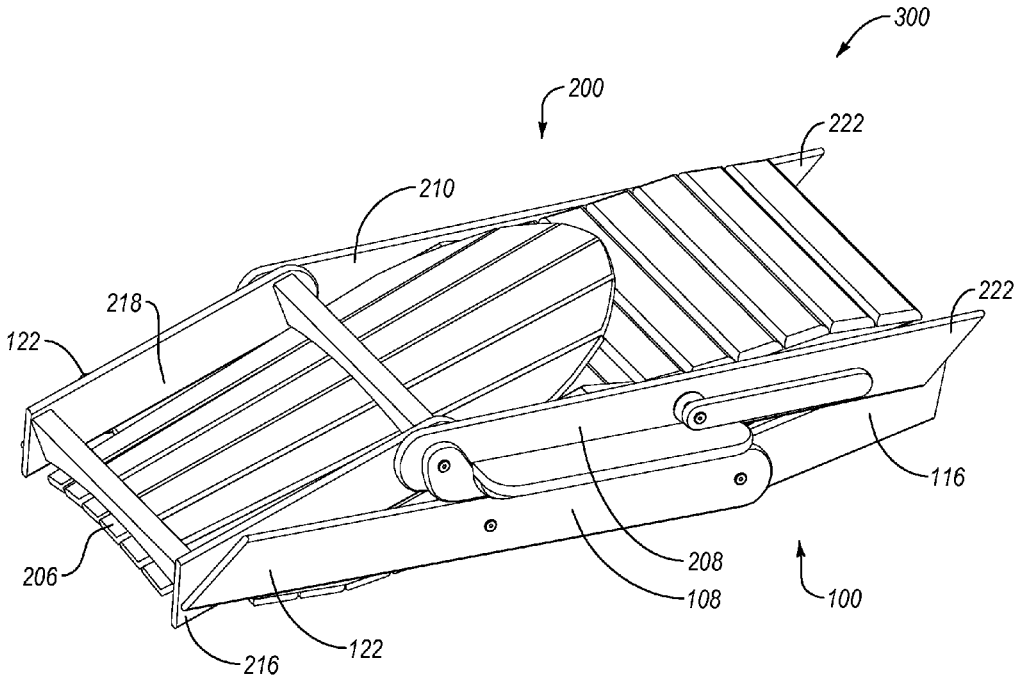
FIGS. 6A-6B illustrate the collapsed chair and stacked table of FIG. 5 with the collapsed lounge lowered so as to stack with the table and chair.
Figure 6B:
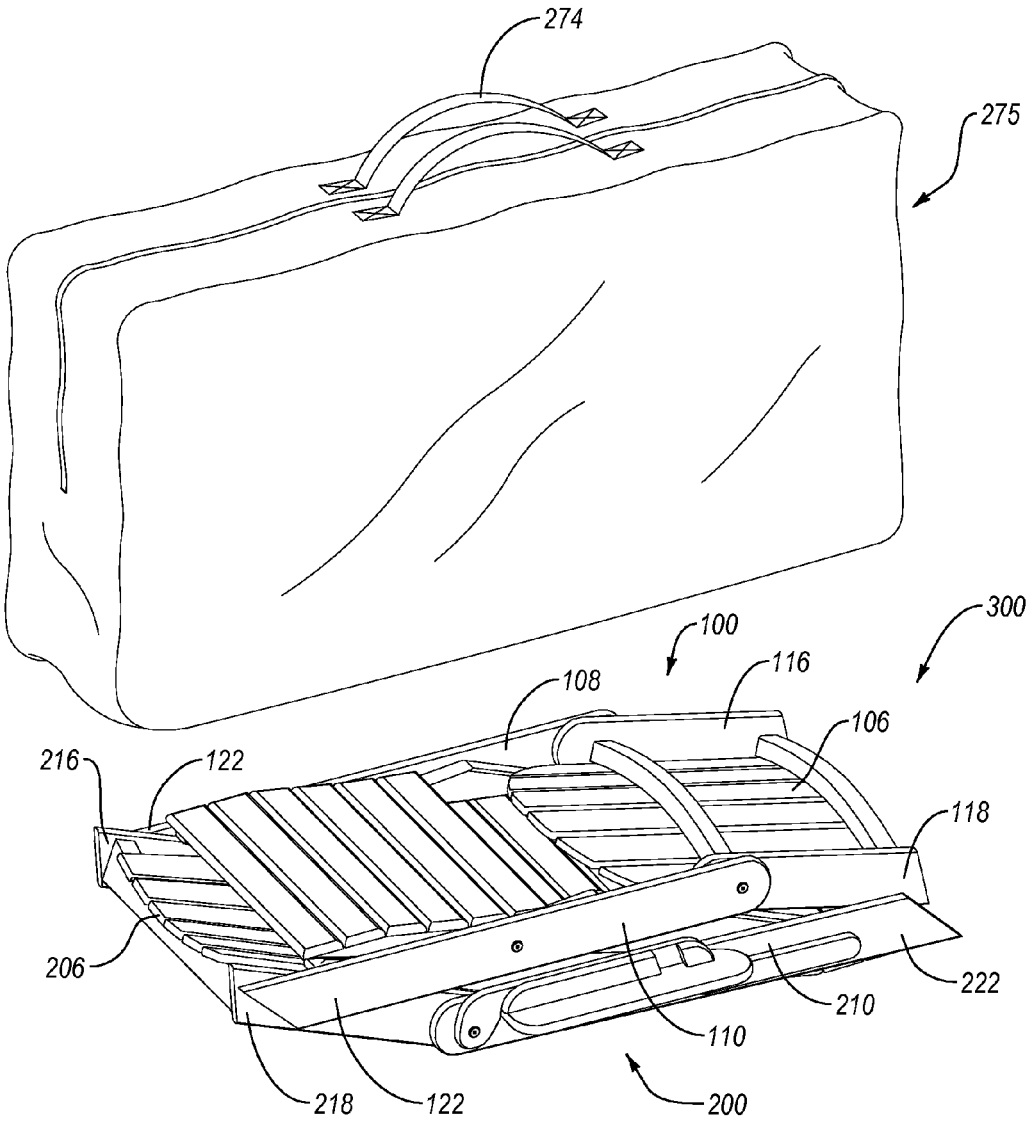

FIGS. 4-6 show how the chair 100, the lounge chair 200, and the collapsible table 260 comprise a system 300 that may be collapsed and nested together for storage or transport. For example, as shown in FIG. 4, chair 100 is collapsed. As shown in FIG. 5, collapsed table 260 may be stacked on collapsed chair 100 so that the table top member 262 abuts against lateral brace 121 of chair 100, preventing table 260 from sliding longitudinally past brace 121. As shown in FIG. 6A, lounge chair 200 may be lowered over chair 100 such that lounge chair 200 and chair 100 nest together relative to one another. In particular, the chair 100 and lounge chair 200 are oriented head-to-foot relative to one another, as seen in FIGS. 4 and 5. Front legs 122 of chair 100 define an inside width into which the bottom of back supporting member 206 (i.e., edge members 216 and 218) of lounge chair 200 nest, while front legs 222 of lounge chair 200 define an inside width into which the bottom portion of back supporting member 106 (i.e., edge members 116 and 118) of chair 100 nests, interlocking the chair 100 and lounge chair 200 together into a compact, collapsed configuration. As seen in FIG. 6B, a portable zipper closure bag 275 (e.g., formed of canvas, heavy duty nylon, or other suitable fabric) may be provided into which the nested chair 100 and lounge chair may be portably stored. Bag 275 may include a handle 274 to facilitate easy carrying of the system 300.

The system components (including the chairs and table) may be made of any suitable material, such as any type of wood, including engineered wood. Other materials may include, but are not limited to, plastics (e.g., plastic molded to have the appearance of wood lumber), metal, or composite materials. In one embodiment, the chair is either made of wood, or made of a material made to look like wood (e.g., plastic lumber or engineered composite lumber). In another embodiment, the chair may be formed of metal or plastic and provided with a more contemporary appearance.

While various aspects and embodiments have been disclosed herein, other aspects and embodiments are contemplated. The various aspects and embodiments disclosed herein are for purposes of illustration and are not intended to be limiting. As used in this specification and the appended claims, the singular forms "a", "an" and "the" include plural referents unless the context clearly dictates otherwise. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A lounge chair comprising:

a base member comprising a seat surface configured to support a user sitting thereon;

a back supporting member behind the seat surface, the back supporting member being configured to support a user's back when a user is seated on the seat surface; and a first side member including first and second fulcrums, the first side member being connected to a side of the base member through the first fulcrum and the first side member also being connected to a side of the back supporting member only through the second fulcrum, the second fulcrum being is spaced apart from the first fulcrum;

a second side member including first and second spaced apart fulcrums aligned with the first and second fulcrums of the first side member, respectively, the second side member being connected to the base member through the first fulcrum and the second side member also being connected to the back supporting member through the second fulcrum, the second side member being substantially parallel to and oppositely disposed relative to the first side member so as to be connected to an opposite side of the base member and the back supporting member;

the entire back supporting member being pivotable about the second fulcrums, and the base member being pivotable about the first fulcrums to collapse the chair to a more compact configuration for storage;

wherein both side members are substantially straight, wherein the first fulcrums of the first and second side members are disposed at about a center of each side member, the second fulcrums of the first and second side members are disposed near a top end of each side member, and oppositely disposed bottom ends of each side member serve as front legs of the chair that support the chair on a surface;

wherein the base member is substantially straight and comprises a front end, a central portion, and a back end, the seat surface being disposed at the front end of the base member, the first and second side members being connected to the central portion of the base member through the first fulcrums, and the back end of the base member serving as back legs of the chair that support the chair on a surface;

a leg rest assembly comprising:

a leg rest member hingedly connected to the base member so that the leg rest member is disposed in front of the seat surface of the base member and can be selectively rotated under the seat surface of the base member; and opposing leg rest member support legs each extending from a first free end to an oppositely disposed second end that is hingedly connected to the leg rest member so that the opposing support legs of the leg rest assembly can be pivoted so that the free end of each support leg extends downward so as to serve as legs of the leg rest assembly that support the leg rest assembly on a surface; and opposing arm rest assemblies connected to the side members, each arm rest assembly including a substantially horizontal arm rest member extending between a first free end and an opposite second end connected to a respective side member at the second fulcrum, each arm rest assembly further comprising a selectively positionable support member having a free first end that is positionable within a slot near the first free end of the corresponding arm rest member, an oppositely disposed second end of the support member being connected to a respective side member at the first fulcrum.

2. The lounge chair as recited in claim 1, wherein the lounge chair further comprises a lateral brace extending between a central portion of the first and second side members, the lateral brace being substantially aligned with the first fulcrum.

3. The lounge chair as recited in claim 1, wherein the back supporting member and the base member are not directly connected to one another.

4. The lounge chair of claim 1, wherein the lounge chair is made of wood or made of a material made to look like wood.

5. The lounge chair of claim 1, wherein the first fulcrum is disposed at a location about ⅓ along a length of the base member as measured from a front edge of the seat member.

6. A system including a collapsible chair and a collapsible lounge chair wherein the collapsible chair and collapsible lounge chair become nested together when collapsed, wherein:

the collapsible chair comprises:

a base member comprising a seat surface configured to support a user sitting thereon;

a back supporting member behind the seat surface, the back supporting member being configured to support a user's back when a user is seated on the seat surface; and a first side member including first and second fulcrums, the first side member being connected to a side of the base member through the first fulcrum and the first side member also being connected to a side of the back supporting member only through the second fulcrum, the second fulcrum being is spaced apart from the first fulcrum;

a second side member including first and second spaced apart fulcrums aligned with the first and second fulcrums of the first side member, respectively, the second side member being connected to the base member through the first fulcrum and the second side member also being connected to the back supporting member through the second fulcrum, the second side member being substantially parallel to and oppositely disposed relative to the first side member so as to be connected to an opposite side of the base member and the back supporting member; and the entire back supporting member being pivotable about the second fulcrums, and the base member being pivotable about the first fulcrums to collapse the chair to a more compact configuration for storage;

wherein the collapsible lounge chair comprises a base member comprising a seat surface configured to support a user sitting thereon;

a back supporting member behind the seat surface, the back supporting member being configured to support a user's back when a user is seated on the seat surface; and a first side member including first and second fulcrums, the first side member being connected to a side of the base member through the first fulcrum and the first side member also being connected to a side of the back supporting member only through the second fulcrum, the second fulcrum being is spaced apart from the first fulcrum;

a second side member including first and second spaced apart fulcrums aligned with the first and second fulcrums of the first side member, respectively, the second side member being connected to the base member through the first fulcrum and the second side member also being connected to the back supporting member through the second fulcrum, the second side member being substantially parallel to and oppositely disposed relative to the first side member so as to be connected to an opposite side of the base member and the back supporting member;

the entire back supporting member being pivotable about the second fulcrums, and the base member being pivotable about the first fulcrums to collapse the chair to a more compact configuration for storage;

wherein both side members are substantially straight, wherein the first fulcrums of the first and second side members are disposed at about a center of each side member, the second fulcrums of the first and second side members are disposed near a top end of each side member, and oppositely disposed bottom ends of each side member serve as front legs of the lounge chair that support the lounge chair on a surface;

wherein the base member is substantially straight and comprises a front end, a central portion, and a back end, the seat surface being disposed at the front end of the base member, the first and second side members being connected to the central portion of the base member through the first fulcrums, and the back end of the base member serving as back legs of the lounge chair that support the lounge chair on a surface;

a leg rest assembly comprising:

a leg rest member hingedly connected to the base member so that the leg rest member is disposed in front of the seat surface of the base member and can be selectively rotated under the seat surface of the base member; and opposing leg rest member support legs each extending from a first free end to an oppositely disposed second end that is hingedly connected to the leg rest member so that the opposing support legs of the leg rest assembly can be pivoted so that the free end of each support leg extends downward so as to serve as legs of the leg rest assembly that support the leg rest assembly on a surface; and opposing arm rest assemblies connected to the side members, each arm rest assembly including a substantially horizontal arm rest member extending between a first free end and an opposite second end connected to a respective side member at the second fulcrum, each arm rest assembly further comprising a selectively positionable support member having a free first end that is positionable within a slot near the first free end of the corresponding arm rest member, an oppositely disposed second end of the support member being connected to a respective side member at the first fulcrum;

wherein when both the collapsible chair and the collapsible lounge chair are collapsed, and the collapsible lounge chair is oriented head-to-foot relative to the collapsible chair, the front legs of the collapsible chair define an inside width into which a bottom of the back supporting member of the collapsible lounge chair nests; and the front legs of the collapsible lounge chair define an inside width into which a bottom of the back supporting member of the collapsible chair nests, interlocking the collapsible chair and the collapsible lounge chair together in a compact, collapsed configuration.

7. A system as recited in claim 6, further comprising a collapsible table comprising:

a table top member; and a pair of opposed scissoring legs, each scissoring leg including a first leg and a second leg which are pivotally connected to one another at a central portion of each first and second leg, wherein a lower free end of each first leg and each second leg serves to support the table on a surface and an upper end of each first leg is hingedly connected to a bottom surface near an end of the table top member while an upper end of each second leg is free to abut against a stop disposed on a bottom surface of the table top at an end opposite where the ends of the first legs are hingedly connected to the tabletop;

wherein when the table is collapsed, the back legs of the collapsible chair define an inside width into which the table top member of the collapsible table nests so that the collapsible table is nested between the collapsible chair and the collapsible lounge chair.

8. A system as recited in claim 7, wherein the collapsible chair further comprises a lateral brace extending between a central portion of the first and second side members, the lateral brace being substantially aligned with the first fulcrum, the lateral brace providing a stop against which the table top member is abutted when the collapsible table is nested between the collapsible chair and the collapsible lounge chair.

9. The system of claim 7, wherein the collapsible chair, the collapsible lounge chair, and the table are made of wood or made of a material made to look like wood.

10. The system of claim 6, wherein the collapsible chair and the collapsible lounge chair are made of wood or made of a material made to look like wood.

11. A system as recited in claim 6, further comprising a portable bag into which the nested collapsible chair and collapsible lounge chair may be stored.

12. The system of claim 6, wherein both side members of the collapsible chair are substantially straight, wherein the first fulcrums of the first and second side members of the collapsible chair are disposed at about a center of each side member, the second fulcrums of the first and second side members of the collapsible chair are disposed near a top end of each side member of the collapsible chair, and oppositely disposed bottom ends of each side member of the collapsible chair serve as front legs of the collapsible chair that support the collapsible chair on a surface.

13. The system of claim 6, wherein the base member of the collapsible chair is substantially straight and comprises a front end, a central portion, and a back end, the seat surface of the collapsible chair being disposed at the front end of the base member of the collapsible chair, the first and second side members of the collapsible chair being connected to the central portion of the base member of the collapsible chair through the first fulcrums of the collapsible chair, and the back end of the base member of the collapsible chair serving as back legs of the collapsible chair that support the collapsible chair on a surface.

* * * * *